US006146216A

United States Patent [19]

Timsit et al.

[11] Patent Number: 6,146,216

[45] Date of Patent: Nov. 14, 2000

[54] ELECTRICAL WIRE CONNECTOR

[76] Inventors: Roland Sion Timsit, 467 Woburn Avenue, North York, Ontario, Canada, M5M 1L6; Albert Renaud Perrin, 757 Dillman Avenue, Newmarket, Ontario, Canada, L3X 2K3

[21] Appl. No.: 09/290,528

[22] Filed: Apr. 12, 1999

[51] Int. Cl.[7] ..... H01R 4/50

[52] U.S. Cl. ..... 439/783

[58] Field of Search ..... 439/783, 782, 439/763, 775, 781

[56] References Cited

U.S. PATENT DOCUMENTS

| | | | |
|---|---|---|---|
| 1,801,277 | 4/1931 | Kelley . | |
| 3,329,928 | 7/1967 | Broske | 339/247 |
| 4,415,222 | 11/1983 | Polidori | 339/270 R |
| 5,006,081 | 4/1991 | Counsel et al. | 439/783 |
| 5,145,420 | 9/1992 | Counsel et al. | 439/783 |
| 5,151,560 | 9/1992 | Kreinberg et al. | 174/94 R |
| 5,567,186 | 10/1996 | Diniz et al. | 439/783 |
| 5,816,865 | 10/1998 | Chadbourne | 439/783 |
| 5,830,019 | 11/1998 | Chadbourne et al. | 439/783 |
| 5,842,893 | 12/1998 | De Keyser | 439/783 |
| 5,868,588 | 2/1999 | Chadbourrne et al. | 439/783 |
| 5,928,039 | 7/1999 | Adler et al. | 349/783 |
| 5,944,564 | 8/1999 | Chadbourne et al. | 439/783 |
| 6,004,165 | 12/1999 | Dinh et al. | 439/783 |

*Primary Examiner*—Brian Sircus
*Assistant Examiner*—J. F. Duverne

[57] ABSTRACT

An electrical connector includes a C-shaped member (10) for use with a wedge. The C-shaped member includes a bight section (16) and two arcuate ears (18) extending from opposite sides of the bight section. The C-shaped member has an outer surface (24) with laterally extending ribs (22) and grooves (26) in an alternating sequence. The C-shaped member has an inner surface (34) that is initially formed with protrusions (36) each being opposed to one of the grooves. The protrusions compensate for bowing of the inner surface during forming of the arcuate ears, thereby resulting in the inner surface having a planar profile after forming.

1 Claim, 3 Drawing Sheets

ELECTRICAL WIRE CONNECTOR

FIELD OF THE INVENTION

The present invention relates to the field of electrical connectors and, more particularly, to electrical connectors commoning and mechanically securing two electrical wires together.

BACKGROUND OF THE INVENTION

Electrical connectors of the type having a C-shaped body member having converging channels and a complementary wedge member have been known conventionally for many years and are disclosed, for example, in U.S. Pat. Nos. 1,801,277; 4,415,222; 4,606,264; 5,006,081; and 5,145,420; all of which are herein incorporated by reference. Basically, for these wedge type connectors, two uninsulated conductors are electrically and mechanically connected by being pressed into and against interior curved surfaces or channels provided in a C-shaped body member. The pressing is provided by a wedge being driven longitudinally into the C-shaped body member between the conductors. These known wedge connectors have been successfully used in the power utility industry for large diameter cable where the C-shaped body members are massive enough to exert a resilient, compressive force against the cables trapped in the channels of the C-shaped body members by the wedge.

It is desirable to provide a wedge type connector which can provide the same compressive forces against the wire and the wedge, but using a lesser amount of material than the prior art wedge type connectors.

SUMMARY OF THE INVENTION

The practice of the present invention is directed to an electrical connector having a C-shaped member for use with a wedge. The C-shaped member comprises a bight section and two arcuate ears extending therefrom. The C-shaped member has an inner surface and an outer surface. The outer surface has alternating ribs and grooves extending therealong, the inner surface has protrusions extending opposite to the grooves on the outer surface. The ribs have rounded outer edges that extend around the entire outer surface and assist in providing good electrical contact between C-shaped member and the uninsulated conductor therein.

DETAILED DESCRIPTION OF AN EMBODIMENT OF THE INVENTION

FIGS. 1–4 show a C-shaped member 10 of the present invention. The C-shaped member 10 is to be used in a C-shaped member and wedge type connector, the wedge member being known in the art is not shown herein.

The C-shaped member 10, having the benefits to be further described, provides for good electrical connections while being of a lighter weight relative to prior art C-shaped members, yet still has the structural and mechanical benefits of the prior art C-shaped members. The C-shaped member 10 is of a material selected from the group consisting of aluminum alloys of AA6013, AA6016, AA6022, AA6061 and AA6069, wherein the designation AA refers to Aluminum Association. The aluminum alloy AA6013 is available from Alcoa and Kaiser Aluminum and Chemical Co.; AA6016 is available from Algroup Alusuisse; AA6022 is sometimes made available from Alcoa; AA6061 is generally available from aluminum companies; and AA6069 is made available from Northwest Aluminum Company.

Figure 2:
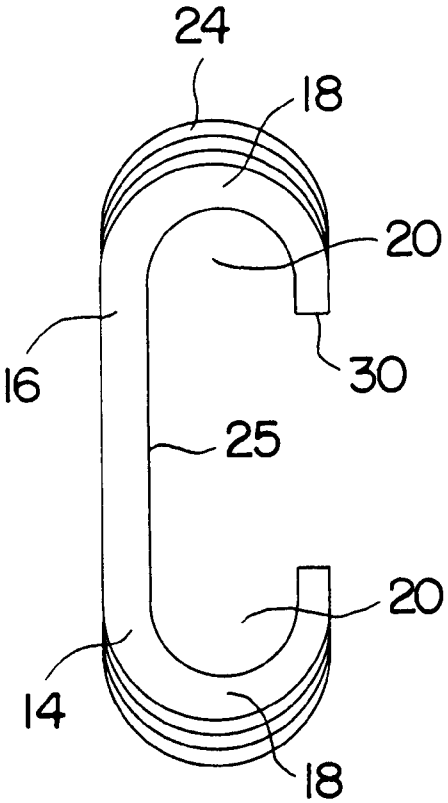
FIG. 2 is an end view of the C-shaped member of FIG. 1.
Figure 1:
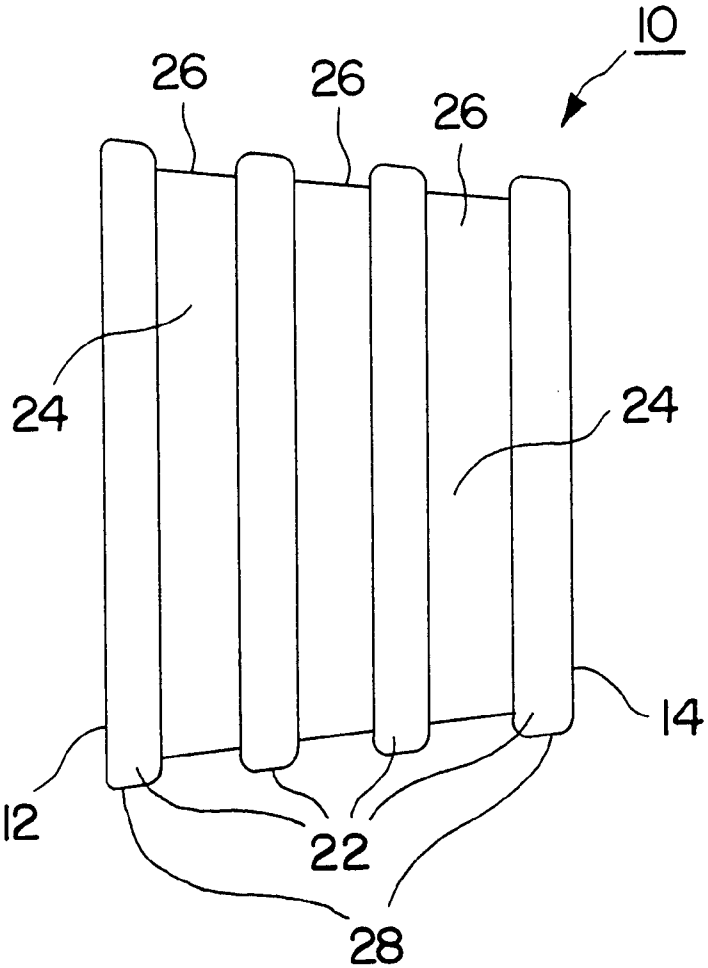
FIG. 1 is a rear view of the C-shaped member of the present invention.

The C-shaped member 10 has a forward end 12 and rearward end 14, the C-shaped member 10 converging from the forward end 12 toward the rearward end 14 (best seen in FIG. 1). The C-shaped member has a bight section 16 (best seen in FIG. 2) and arcuate ears 18 formed on either end thereof. The arcuate ears 18 form two conductor receiving channels 20 (best seen in FIG. 3) which are to receive two uninsulated conductors therein and wherein the wedge will be received between the two uninsulated conductors. As is known in the art, the wedge by its insertion into the C-shaped member provides a compressive force against the uninsulated conductors which, in turn, press against the C-shaped member 10.

The C-shaped member 10 has a series of ribs 22 (best seen in FIG. 1) disposed along an outer surface 24 (best seen in FIG. 2) of the C-shaped member 10. The ribs 22 extend perpendicularly in the direction of the conductor receiving channels 20. Disposed between the ribs 22 are a series of grooves 26 (best seen in FIG. 1). The ribs 22 typically have rounded outer edges 28 to assist in the formation thereof as well as eliminating cracking and extend around the entire outer surface 24 of the C-shaped member 10 along both of the arcuate ears 18 toward both ends 30 (best seen in FIG. 2).

The rounded outer edges 28 of the ribs 22 are important to the present invention because these edges 28 assist in providing good electrical contact between the C-shaped member 10 and the uninsulated conductors therein. More particularly, as the uninsulated conductors are pressed against the C-shaped member 10, due to the insertion of the wedge, the rounded edges allow for their associated regions extending around the entire outer surface 24 to seek and obtain a flush contact with the uninsulated conductors. This flush contact not only provides a low resistance contact between the uninsulated conductors and C-shaped member 10, but also eliminates voids therebetween which may otherwise allow for dirt or other contaminates to find their way onto the surfaces of the mated uninsulated conductors and of the C-shaped member 10 and, thus, degrade the electrical connection therebetween.

If desired, the C-shaped member 10 may comprise ribs 22 with non-rounded edges and variations along the edges that might otherwise prevent a flush contact between the ribs 22 and the uninsulated conductor. These variations may be removed by appropriate machining techniques, such as by providing a crown on the tool used during the machining process, that removes the variations and provides a contoured surface that provides for the desired flush contact. The desired C-shaped member 10 may be further described with reference to FIG. 3.

Figure 3:
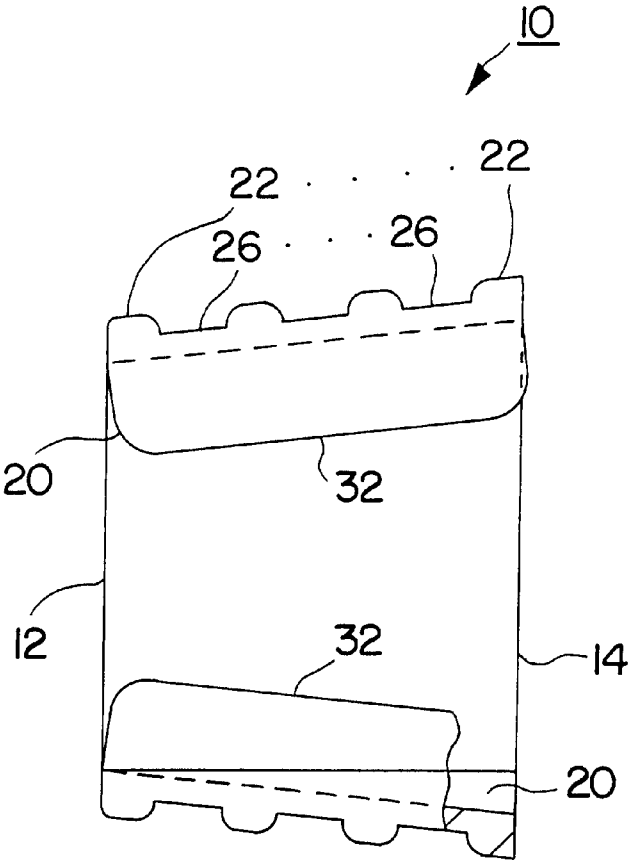
FIG. 3 is a top view, partially cut-away, of the C-shaped member of FIG. 1.

FIG. 3 is a top view of the C-shaped member 10 having lips 32, one of which is shown as being partially cut-away so as to more clearly illustrate the channel 20 thereof.

Figure 4:
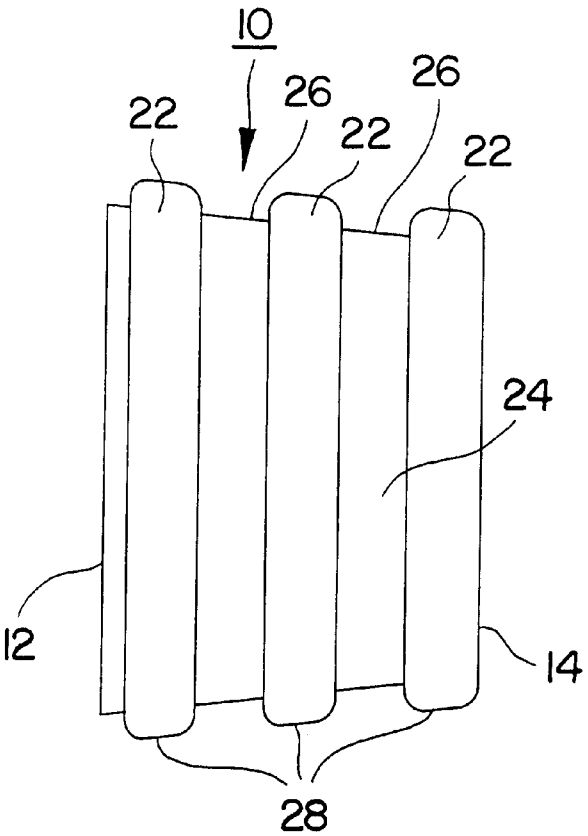
FIG. 4 is an alternative embodiment of the C-shaped member of the present invention.

FIG. 4 shows an alternative embodiment of the C-shaped member 10 wherein only three ribs 22 are disposed along the outer surface 24.

Figure 5:
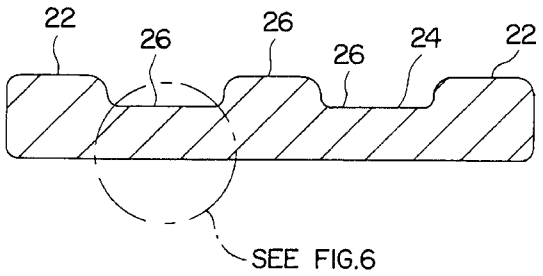
FIG. 5 is a cross-sectional view of the C-shaped member showing the ribs.

FIG. 5 is a cross-sectional view of C-shaped member 10 in its non-curved condition primarily showing the ribs 22 thereof. Further details of the grooves 26 are shown in FIG. 6.

Figure 6:
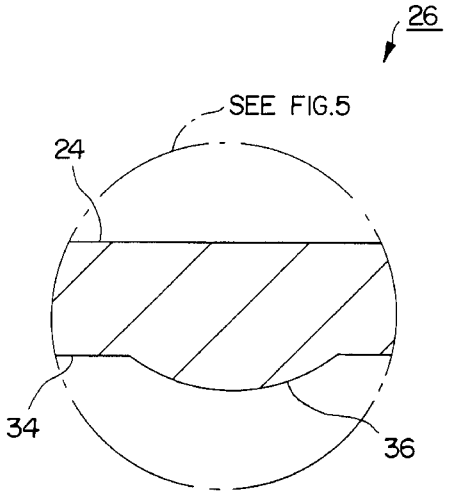
FIG. 6 is an exploded view of a portion of FIG. 5 showing the detail of the grooves located between the ribs of the C-shaped member of the present invention.

FIG. 6 shows the grooves 26 being bounded by the outer surface 24 and inner surface 34 of the C-shaped member 10 and preferably having a protrusion 36 which is of importance to the present invention. Each of the protrusions may be characterized as gently convex and of only incremental height, and faired with the otherwise planar surfaces between the protrusions 36.

The C-shaped member 10 is typically formed from a flat blank having the ribs 22 formed along the outer surface 24 of the blank and preferably having the rounded edges 28 previously discussed. The C-shaped member 10 is then created in a forming operation to bend the ends of the flat member (similar to that of FIG. 5) into the arcuate ears 18 (best seen in FIG. 2). If the inner surface 34 of the C-shaped member 10 is completely flat prior to forming the initially flat member into its C-shape, there is a tendency for the inner surface 34, opposite to the grooves 26, to bow outwardly during the forming operation. This, without the benefits of the present invention, would prevent the C-shaped member 10 from forming a good electrical connection with the conductor along the entire inner surface 34 of the arcuate ear 18.

To alleviate this problem, the protrusion 36 (see FIG. 6) is formed along the inner surface 34 of the blank from which the C-shaped member 10 is formed. The protrusion 36 is formed opposite to the grooves 26. Therefore, during the forming operation the protrusions 36 will compensate for the outward going of the material along the grooves 26; thereby forming a smooth surface along this inner surface 34 to form a good electrical and mechanical connection with the uninsulated conductors within the arcuate ears 18.

For one example, the protrusion 36 extends 0.015 inch from the inner surface 34. The protrusion 36 may be different heights from the inner surface 34 depending on the specific dimensions of the C-shaped member 10.

An advantage of the invention is that the C-shaped members can be formed having alternating ribs and grooves along the outer surface while still providing enough strength for the entire C-shaped member 10 because of the ribs 22 and also saving total material cost because of the grooves 26. Moreover, the C-shaped members, formed from the aluminum alloys AA6013, AA6016, AA6022, AA6061 or AA6069 of the present invention, are about 30% lighter than prior art connectors. The addition of the protrusions 36 along the opposite surface from the grooves 26 provides the inner surface 34 with a continuous or planar electrically conductive surface after forming for the connection between the uninsulated conductors and the C-shaped member 10. Furthermore, the presence of the rounded outer edges 28 further enhances the continuous (no disruptions) electrical conductive surface which, in turn, enhances the low resistance between the uninsulated conductors and the C-shaped member 10.

It is felt that the electrical connector of the present invention and many of their attendant advantages will be understood from the foregoing description. It is apparent that various changes may be made in the form, construction, and arrangement of parts thereof without departing from the spirit or scope of the invention, or sacrificing all of its material advantages.

What is claimed is:

1. An electrical connector comprising:

a C-shaped member extending longitudinally from a forward end to a rearward end, the C-shaped member including a bight section and two arcuate ears extending from opposite sides of the bight section, the C-shaped member having an outer surface and an inner surface, the outer surface having a plurality of laterally extending ribs and grooves disposed in an alternating sequence between the forward end and the rearward end, and the inner surface is initially formed with a plurality of protrusions each being opposed to one of the grooves, wherein the protrusions compensate for bowing of the inner surface during forming of the arcuate ears, wherein the inner surface has a planar profile after forming of the arcuate ears.

* * * * *